US007477120B2

(12) United States Patent
Gu et al.

(10) Patent No.: US 7,477,120 B2
(45) Date of Patent: Jan. 13, 2009

(54) TRANSFORMER SHIELDING

(75) Inventors: Wenjian Gu, Hopkinton, MA (US); Robert P. Parker, Westborough, MA (US); James A. Sozanski, Bolton, MA (US)

(73) Assignee: Bose Corporation, Framingham, MA (US)

( * ) Notice: Subject to any disclaimer, the term of this patent is extended or adjusted under 35 U.S.C. 154(b) by 1283 days.

(21) Appl. No.: 09/928,775

(22) Filed: Aug. 13, 2001

(65) Prior Publication Data

US 2003/0030534 A1 Feb. 13, 2003

(51) Int. Cl.
*H01F 27/32* (2006.01)

(52) U.S. Cl. ..... 336/84 C

(58) Field of Classification Search ..... 336/83, 336/84 M, 84 R, 84 C; 174/35 R, 35 SM, 174/35 CE, 36; 323/359
See application file for complete search history.

(56) References Cited

U.S. PATENT DOCUMENTS

| | | | | |
|---|---|---|---|---|
| 792,248 | A | 6/1905 | Campbell | |
| 3,376,523 | A | 4/1968 | Kerns | |
| 3,376,531 | A * | 4/1968 | Fischer et al. | 174/35 R |
| 3,465,232 | A | 9/1969 | Weber | 321/8 |
| 3,963,975 | A | 6/1976 | Gauper, Jr. et al. | 321/2 |
| 4,089,049 | A | 5/1978 | Suzuki et al. | 336/17 |
| 4,156,829 | A | 5/1979 | Harada | |
| 4,223,245 | A | 9/1980 | Ogura et al. | |
| 4,484,171 | A | 11/1984 | McLoughlin | 336/84 R |
| 4,977,301 | A | 12/1990 | Maehara et al. | 219/10.55 B |
| 5,107,411 | A | 4/1992 | Misdom | 363/20 |
| 5,386,148 | A | 1/1995 | Fiori, Jr. | |
| 5,724,236 | A | 3/1998 | Oglesbee | 363/40 |
| 6,197,408 | B1 * | 3/2001 | Kanbara et al. | 428/209 |

FOREIGN PATENT DOCUMENTS

| | | | |
|---|---|---|---|
| CN | 1039686 | A | 2/1990 |
| CN | 2269026 | Y | 11/1997 |
| CN | 1167563 | A | 12/1997 |
| EP | 0291093 | A2 | 11/1988 |
| JP | 61-201404 | * | 9/1986 |
| JP | 63-84106 | | 4/1988 |
| JP | 6-132146 | | 5/1994 |
| JP | 6-181132 | * | 6/1994 |
| JP | 6-283340 | | 10/1994 |
| JP | 2001075654 | | 3/2001 |
| JP | 2001075654 | A | 3/2001 |
| WO | WO 98/50956 | | 11/1998 |

OTHER PUBLICATIONS

Copy of Japanese Office Action received in counterpart JP Application No. 2002-235626, dated Apr. 1, 2008.

* cited by examiner

*Primary Examiner*—Tuyen T. Nguyen
(74) *Attorney, Agent, or Firm*—Fish & Richardson P.C.

(57) ABSTRACT

An electrical transformer having a core with two core portions having a shield for electrically shielding one core portion from the other core portion.

54 Claims, 4 Drawing Sheets

TRANSFORMER SHIELDING

STATEMENT REGARDING FEDERALLY SPONSORED RESEARCH OR DEVELOPMENT

This invention involves no federally sponsored research or development.

BACKGROUND OF THE INVENTION

The invention relates to electrical transformers, and more particularly to shielding of transformers to reduce interference due to electromagnetic radiation.

It is an important object of the invention to provide an improved electrical transformer and transformer shield.

BRIEF SUMMARY OF THE INVENTION

According to the invention, an electrical transformer for converting a first voltage to a second voltage includes a core which includes a first core portion and a second core portion. The electrical transformer device further includes a shielding device, for electrically shielding said first core portion from said second core portion.

In another aspect of the invention, the transformer incorporating the invention is a component in switching circuitry, such as an amplifier or power supply.

In a more specific aspect of the invention, a power supply for an electronic device, includes input terminals for inputting line electrical power, a rectifier, for rectifying said line electrical power to produce rectified electrical power, a switching circuit, for switching said rectified electrical power to produce switched rectified electrical power, a transformer, for modifying said voltage. The transformer includes a core comprising a first core portion and a second core portion and a first shielding device, for electrically shielding said first core portion from said second core portion.

In another aspect of the invention, an electronic device includes an antenna, for receiving radio frequency signals, a tuner, for tuning said radio frequency signals, and a switching power supply, for providing electrical power to said tuner. The switching power supply includes a transformer that has a first core portion, a second core portion, primary windings, and secondary windings. The transformer further includes a shielding device, for electrically shielding said first core portion from said second core portion.

In still another aspect of the invention, an electrical transformer has a first core portion, a second core portions, first windings, and second windings. A shielding device is designed and constructed to shield said first core portion from said second core portion.

Other features, objects, and advantages will become apparent from the following detailed description, which refers to the following drawing in which:

DETAILED DESCRIPTION

Figure 1:
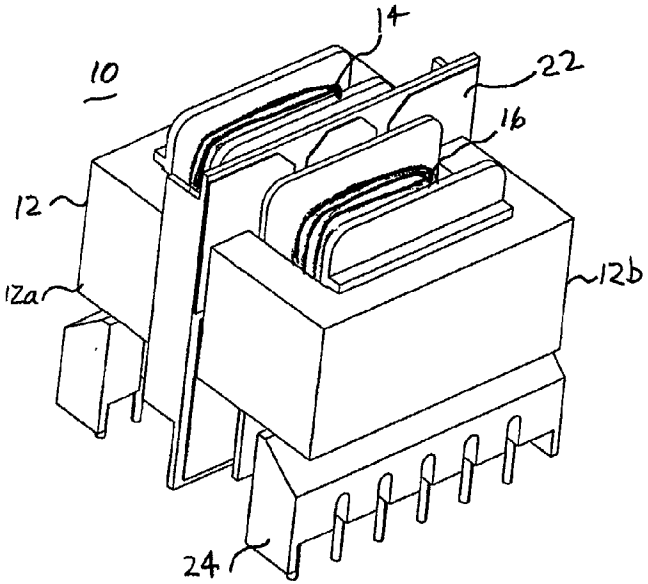
FIG. 1 is an isometric view of a transformer assembly incorporating the invention.

With reference now to the drawing and more particularly to FIG. 1, there is shown a transformer assembly incorporating the invention. Transformer assembly 10 includes a core 12 consisting of two sections 12*a* and 12*b*. Primary winding 14 is wound around first core portion 12*a*, and secondary winding 16 is wound around second core portion 12*b*. Electrostatic shield 22 electrically isolates primary winding 14 from secondary winding 16 and also electrically isolates core first core portion 12*a* from second core portion 12*b*. Electrostatic shield 22 will be discussed more fully below. Plastic bobbin 24 may be provided to hold core portions 12*a* and 12*b* in place, to facilitate the formation of the primary and secondary windings, to provide connecting pins for electrical connections to other devices, and to provide a mechanical support for the core portions 12*a* and 12*b*.

Figure 2:
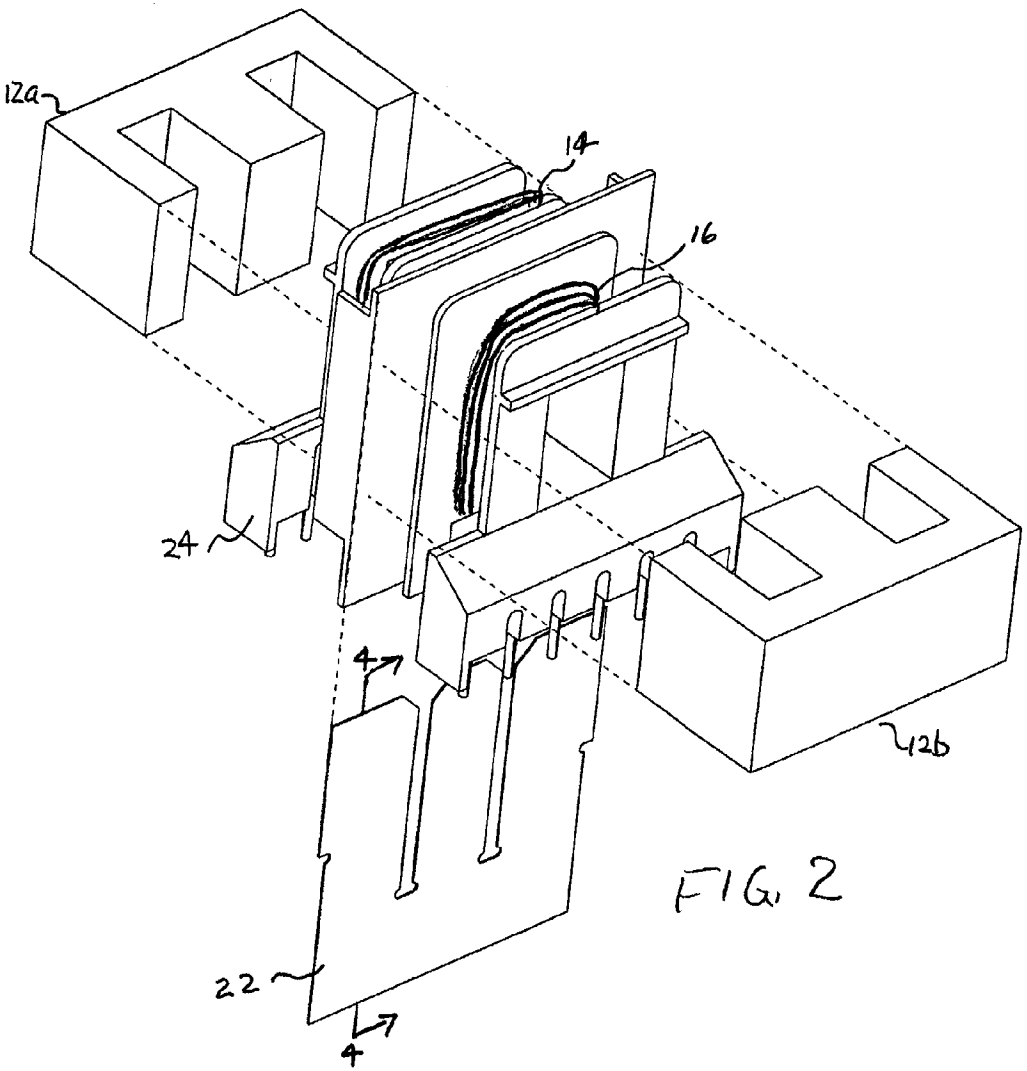
FIG. 2 is an exploded isometric view of the transformer assembly of FIG. 1.

Referring now to FIG. 2, there is shown an exploded view of the transformer assembly of FIG. 1. First core portion 12*a* and second core portion 12*b* are "E" shaped and reverse "E" shaped blocks of a substance, such as ferrite that has a high magnetic permeability. Other shapes for the core portions include "C" and reverse "C" shapes, half-rings, and many others. Electrostatic shield 22 is shaped and positioned such that it lies between the first core portion and the second core portion, and may be further positioned such that it lies between the primary winding and the secondary winding.

Figure 3:
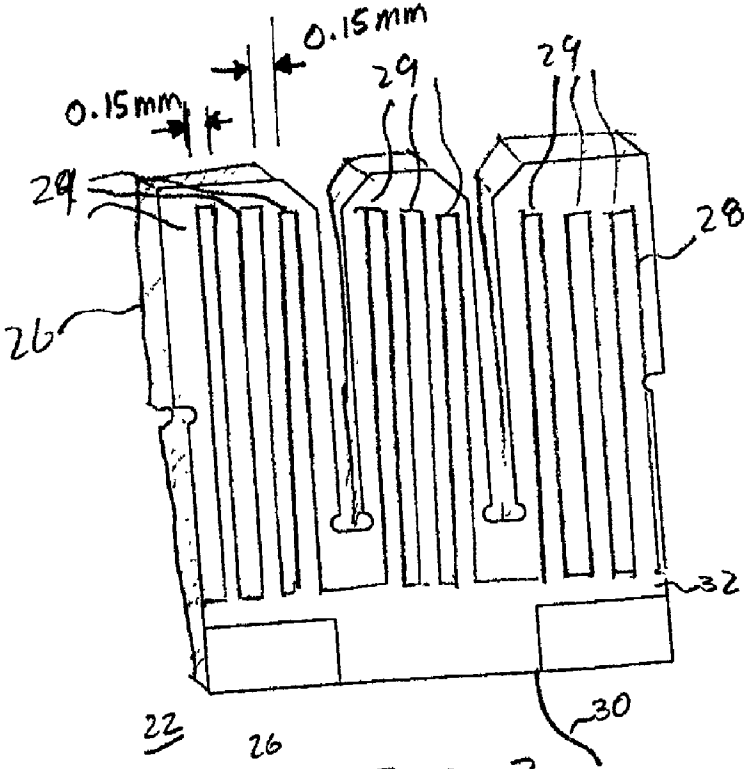
FIG. 3 is a first implementation of a transformer shield according to the invention.

Referring to FIG. 3, there is shown one implementation of an electrostatic shield 22. Electrostatic shield 22 includes a substrate 26 of printed circuit board substrate material. On one surface (hereinafter the conductive surface) of the substrate 26 is a pattern 28 of an electrically conductive material such as copper, in a comb-type pattern consisting of parallel traces 29 of copper electrically connected at one end by a connecting trace 32. A drain wire 30 (or some other electrically conductive component) is electrically connected to the connecting trace 32 of the pattern of electrically conductive material and is connectable to a circuit portion which conducts capacitive displacement currents to their source. In addition to comb-type patterns, other patterns of conductive material can be used. A desirable characteristic of the patterns is that they avoid large area loops which would conduct significant eddy currents which could interfere with the magnetic field of the core 12. In one embodiment of the implementation of FIG. 3, substrate 26 is 0.2 mm thick and 44.7 mm wide. There are 148 copper parallel traces 29 that are 0.15 mm wide and separated by 0.15 mm. For clarity, the traces in FIG. 3 are not shown in scale; the number of parallel traces and the dimensions of the traces are as described above. In one embodiment, the electrostatic shield is positioned such that the conductive surface faces the primary winding 14 and first core portion 12*a*. The implementation of FIG. 3 may be constructed and arranged such that the conductive pattern 28 is in electrical contact with first core portion 12*a* so that any electrical currents that may occur in first core portion 12*a* are conducted away by drain wire 30.

Figure 4:
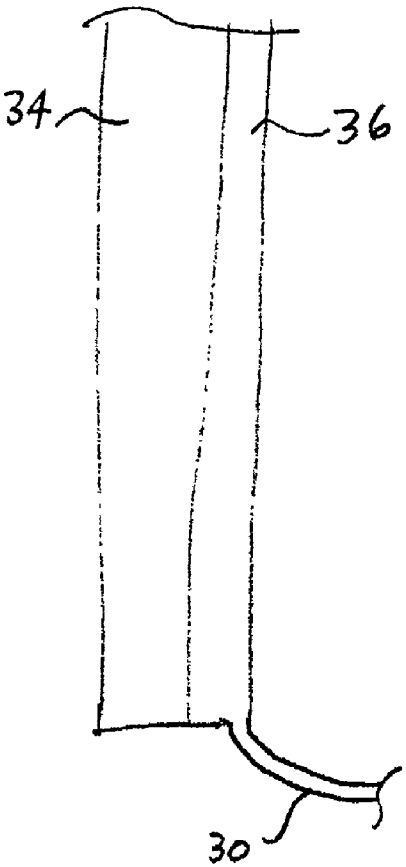
FIG. 4 is a cross section of a second implementation of a transformer according to the invention.

Referring to FIG. 4, there is shown a cross section taken along line 4-4 of FIG. 2 of a second implementation of the electrostatic shield 22. A thin layer of electrically insulating material 34 (such as 0.2 mm thick polyester is covered with a thin conductive layer 36 (such as indium tin oxide). The thickness and the electrical characteristics of the conductive layer are selected such that the surface conductivity is about 20 ohms per square and so that there are only insignificant eddy currents in the conductive layer which have an insignificant effect on the magnetic field of the core 12. The dimensions and electrical characteristics of the conductive layer are further selected such that there is sufficient electrical conductivity to return capacitive displacement electrical currents to a drain wire 30 so that the capacitive displacement currents can be returned to their source.

Figure 5:
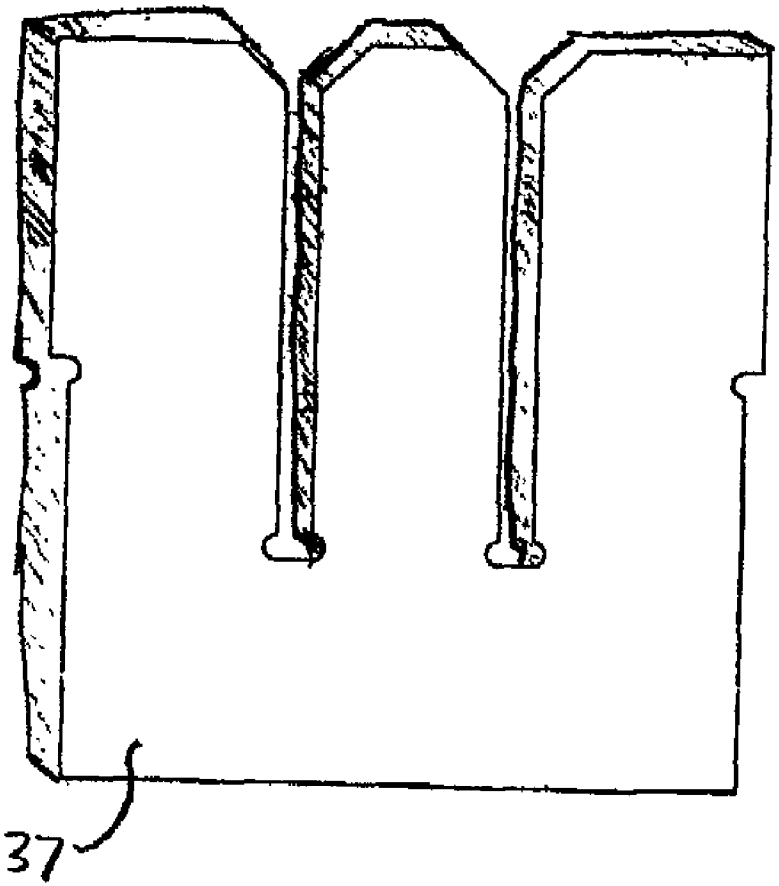
FIG. 5 is a third implementation of a transformer according to the invention.

Referring to FIG. 5, there is shown a third implementation of electrostatic shield 22. The shield of FIG. 5 is a sheet 37 of substantially uniformly conductive material, with a surface resistivity in the range of 10 ohms to 100 ohms per square. The physical and electrical dimensions of the sheet are selected such that there is sufficient conductivity to return capacitive displacement currents to drain wire 30, and so that the effect on the magnetic field of the core 12 is insignificant. A sheet of carbon impregnated polymer, 0.2 mm thick is suitable.

Figure 6:
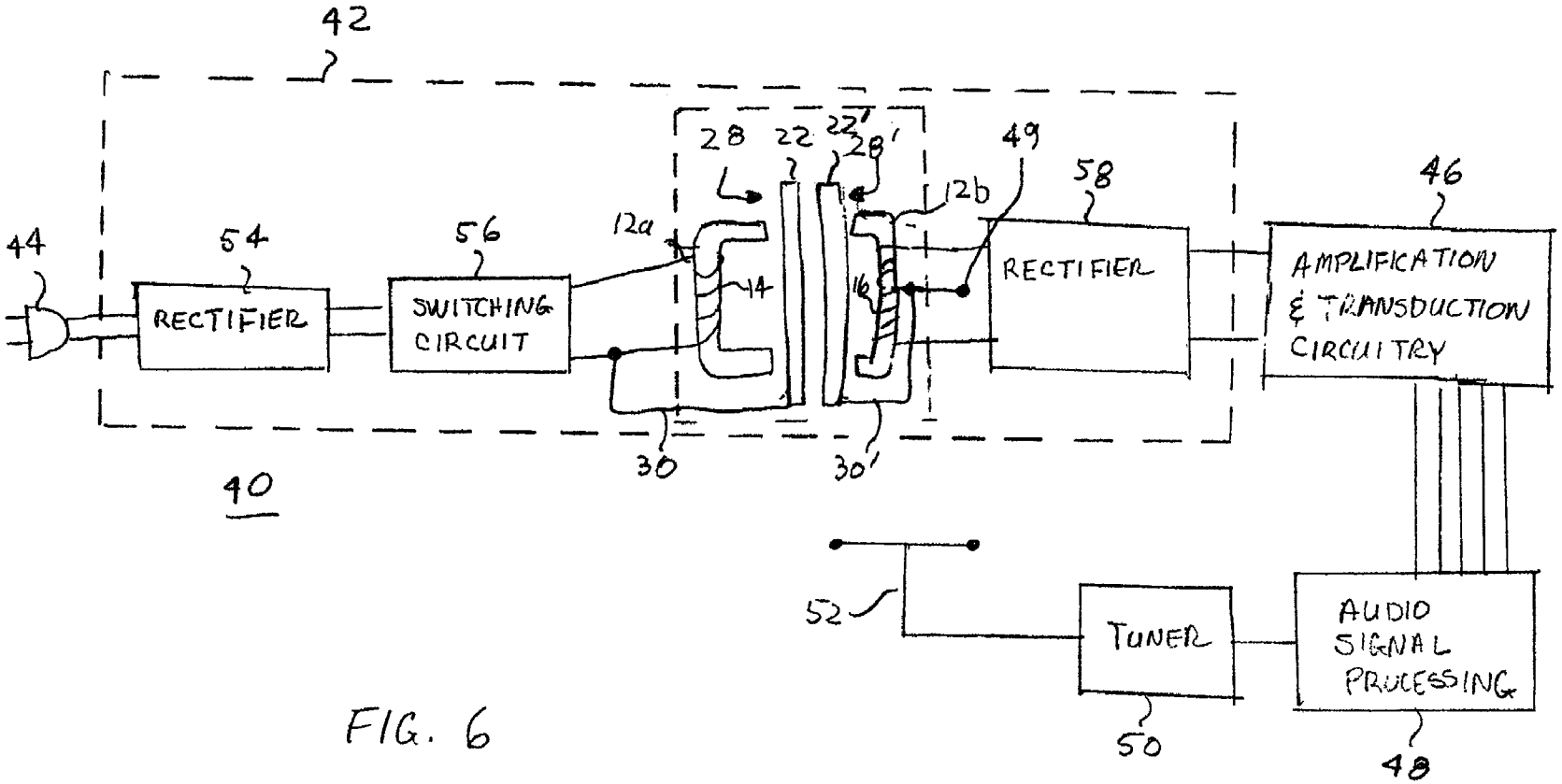
FIG. 6 is block diagram of an electronic device incorporating the invention.

Referring to FIG. 6, there is shown a block diagram of an electronic device incorporating a shielded transformer according to the invention. An audio system 40 includes a switching power supply 42 which receives electrical power from a power plug 44 which is connectable to an outside source of electrical power (such as line AC power). Switching power supply 42 converts the line electrical power to electrical power for an audio signal amplification and transduction circuitry 46. The audio signal amplification and transduction circuitry 46 amplifies and transduces to sound waves audio signals from audio signal processor 48. Audio signal processor 48 processes audio signals from a number of sources, including AM/FM tuner 50. AM/FM tuner 52 receives and tunes radio signal received from antenna 52.

Switching power supply 42 includes a first rectifier 54 and a switching circuit 56 coupled to transformer 10 according to the invention. Transformer 10 includes an electrostatic shield 22 positioned between the two core portions 12*a* and 12*b*, and between the primary winding 14 and secondary winding 16, with the conductive pattern (28 of FIG. 3. or 36 of FIG. 4) facing primary winding 14 and first core portion 12*a*. Drain wire 30 connects conductive pattern (28 of FIG. 3 or 36 of FIG. 4) oF electrostatic shield 22 to switching circuit 56. Optional second electrostatic shield 22' is positioned between two core portions 12*a* and 12*b* and between primary winding 14 and secondary winding 16, with the conductive pattern or layer (28 of FIG. 3 or 36 of FIG. 4) of electrostatic shield 22' facing secondary winding 16 and second core portion 12*b*. Drain wire 30' of electrostatic shield 22' connects conductive pattern to a common lead 49 to secondary winding 16. Terminals of secondary winding 16 are coupled to second rectifier 58, which is coupled to audio signal amplification and transduction circuitry 46, which amplifies and transduces audio signals received from audio signal processor 48. The switching circuit 56 may modulate the voltage on the secondary windings 16 by a number or methods, including frequency modulation, pulse modulation, or pulse width modulation, and others. An alternative arrangement of the combination of electrostatic shield 22 and electrostatic shield 22' is a single electrically insulative substrate of sufficient thickness with a first conductive pattern or layer (28 of FIG. 3 or 36 FIG. 4) on a surface of the substrate facing first core portion 12*a* and primary winding 14 and a second conductive pattern or layer (28 of FIG. 3 or 36 FIG. 4) on a second surface of the substrate facing second core portion 12*b* and secondary winding 16.

In operation, rectifier 54 rectifies AC line electrical power to DC electrical power. Switching circuit 56 converts the DC electrical power to electrical pulses, typically of a significantly higher frequency than the AC line electrical power. Transformer 10 transforms the electrical pulses to a different, typically lower, voltage. Second rectifier 58 converts the high frequency output of transformer 10 to DC of an appropriate voltage to power audio signal amplification and transduction circuitry 46. Audio signal amplification and transduction circuitry 16 amplifies and transduces audio signals received from audio signal processor 48. The voltage level at the output terminals of rectifier 58 is modulated by the switching circuit 56. Modulation may be done by a number of methods, including frequency modulation, pulse modulation, or pulse width modulation, and others. First electrostatic shield 22 and second electrostatic shield 22' shield conduct any capacitive displacement electrical currents back to the source of the electrical currents, thereby minimizing electro-magnetic radiation from transformer assembly 10.

An electronic device according to the invention is advantageous because capacitive displacement charges between both windings and between core halves are significantly attenuated. There is therefore less need for EMI filtering of power line and output wires. Additionally, since a device incorporating the invention produces less electromagnetic interference, there is less need for EMI shielding of the device relative to nearby electronic devices components or devices. The shield can be manufactured inexpensively and integrated into the transformer easily. A transformer incorporating the shield has less need for more expensive EMI shielding devices that may be more difficult to assemble and may interfere with other functions, such as preventing overheating of the transformer.

In transformers having more than two core portions, multiple shields may be employed to shield one core portion from two or more other core portions.

A transformer shield according to the invention inhibits capacitive displacement currents flowing between core portions of a transformer without significantly affecting the magnetic properties of the core portions. A transformer incorporating the invention may have significantly less EMI radiation than conventional transformers.

It is evident that those skilled in the art may now make numerous uses of and departures from the specific apparatus and techniques disclosed herein without departing from the inventive concepts. Consequently, the invention is to be construed as embracing each and every novel feature and novel combination of features disclosed herein and limited only by the spirit and scope of the appended claims.

What is claimed is:

1. An electrical transformer for converting a first voltage to a second voltage, comprising:

a core comprising a first core portion and a second core portion; and a first shielding device constructed and arranged to electrically shield said first core portion from said second core portion, the first shielding device having an electrically conductive portion on a surface thereof, the electrically conductive portion being electrically connected to a drain wire for conducting capacitive displacement currents back to their source.

2. An electrical transformer in accordance with claim 1 and further comprising, a first winding around said first core portion, and a second winding around said second core portion;

said shielding device constructed and arranged to shield said first winding from said second winding.

3. An electrical transformer in accordance with claim 1 wherein said shielding device comprises, an electrically insulating substrate, and wherein the electrically conductive portion includes a pattern of electrically conductive material disposed on said substrate.

4. An electrical transformer in accordance with claim 3 wherein said pattern comprises, a plurality of parallel traces of said electrically conductive material, a connecting trace of said conductive material interconnecting said plurality of parallel traces, and the drain wire being electrically connected to said connecting trace.

5. An electrical transformer in accordance with claim 3 wherein said shielding device is disposed so that said electrically conductive pattern faces said first winding.

6. An electrical transformer in accordance with claim 1 wherein said shielding device comprises, a sheet of material with a surface resistivity in a range of between 10 and 100 ohms per square.

7. An electrical transformer in accordance with claim 6 wherein said material comprises a carbon impregnated polymer.

8. An electrical transformer in accordance with claim 1 wherein said shielding device comprises, an electrically insulating substrate, a conductive coating disposed on said electrically insulating substrate, said conductive coating having a surface resistivity in a range of between 10 and 100 ohms per square.

9. An electrical transformer in accordance with claim 8 wherein said conductive coating comprises indium tin oxide.

10. An electrical transformer in accordance with claim 1 wherein said first shielding device comprises first and second surfaces, said first shielding device having conductive material disposed on said first surface, and wherein said first shielding device is positioned so that said first surface faces said first core portion.

11. An electrical transformer in accordance with claim 10 wherein said conductive material is in contact with said first core portion.

12. An electrical transformer in accordance with claim 1 and further comprising, a second shielding device, said second shielding device comprising first and second surfaces, said second shielding device having conductive material disposed on said second surface, and wherein said shielding device is positioned so that said second surface faces said second core portion.

13. An electrical transformer in accordance with claim 1 wherein said core further comprises, a third core portion, said transformer further comprising a second shielding device constructed and arranged to electrically shield said first core portion form said third core portion.

14. A power supply for an electronic device comprising, input terminals for inputting line electrical power characterized by voltage, a rectifier constructed and arranged to rectify said line electrical power to produce rectified electrical power, a switching circuit constructed and arranged to switch said rectified electrical power to produce switched rectified electrical power, a transformer having a core comprising a first core portion and a second core portion, and a first shielding device constructed and arranged to electrically shield said first core portion from said second core portion, the first shielding device having an electrically conductive portion on a surface thereof, the electrically conductive portion being electrically connected to a drain wire for conducting capacitive displacement currents back to their source.

15. A power supply in accordance with claim 14 and further comprising, a first winding on said first core portion, a second winding on said second core portion, wherein said shielding device is constructed and arranged to shield said first winding from said second winding.

16. A power supply in accordance with claim 14 wherein said shielding device comprises, an electrically insulating substrate, and wherein the electrically conductive portion includes a pattern of electrically conductive material disposed on said substrate.

17. A power supply in accordance with claim 16 wherein said pattern comprises, a plurality of parallel traces of said electrically conductive material, a connecting trace of said electrically conductive material interconnecting said plurality of parallel traces, and the drain wire being electrically connected to said connecting trace.

18. A power supply in accordance with claim 16 wherein said shielding device is disposed with said electrically conductive pattern facing said first winding.

19. A power supply in accordance with claim 14 wherein said shielding device comprises, a sheet of material with a surface resistivity in a range between 10 and 100 ohms per square.

20. A power supply in accordance with claim 19 wherein said material comprises a carbon impregnated polymer.

21. A power supply in accordance with claim 14 wherein said shielding device comprises, an electrically insulating substrate, and a conductive coating having a surface resistivity in a range of between 10 and 100 ohms per square.

22. A power supply in accordance with claim 21 wherein said conductive coating comprises indium tin oxide.

23. A power supply in accordance with claim 14 wherein said first shielding device comprises first and second surfaces, conductive material disposed on said first surface, and wherein said shielding device is positioned so that said first surface faces said first core portion.

24. A power supply in accordance with claim 23 wherein said conductive material is in electrical contact with said first core portion.

25. A power supply in accordance with claim 23 and further comprising, a second shielding device having first and second surfaces with conductive material disposed on said second surface, and wherein said second shielding device is positioned so that said second shielding device second surface faces said second core portion.

26. An electronic device comprising, an antenna, a tuner coupled to said antenna, a switching power supply constructed and arranged to provide electrical power to said tuner, said switching power supply comprising a transformer having a first core portion, a second core portion, a first winding on said first core portion, and a second winding on said second core portion, and a first shielding device constructed and arranged to electrically shield said first core portion from said second core portion, the first shielding device having an electrically conductive portion on a surface thereof, the electrically conductive portion being electrically connected to a drain wire for conducting capacitive displacement currents back to their source.

27. An electronic device in accordance with claim 26 wherein said shielding device is constructed and arranged to shield said first winding from said second winding.

28. An electronic device in accordance with claim 26 wherein said shielding device comprises, an electrically insulating substrate, and wherein the electrically conductive portion includes a pattern of electrically conductive material disposed on said substrate.

29. An electronic device in accordance with claim 28 wherein said pattern comprises, a plurality of parallel traces of said electrically conductive material, a connecting trace of said conducting material interconnecting said plurality of parallel traces, and the drain wire being electrically connected to said connecting trace.

30. An electronic device in accordance with claim 28 wherein said shielding device is disposed with said electrically conductive material facing said primary winding.

31. An electronic device in accordance with claim 26 wherein said shielding device comprises, a sheet of material with a surface resistivity in a range between 10 and 100 ohms per square.

32. An electronic device in accordance with claim 31 wherein said material comprises a carbon impregnated polymer.

33. An electronic device in accordance with claim 26 wherein said shielding device comprises, an electrically insulating substrate, a conductive coating on said substrate having a surface resistivity in a range of between 10 and 100 ohms per square.

34. An electrical transformer in accordance with claim 33 wherein said conductive coating comprises indium tin oxide.

35. An electronic device in accordance with claim 26 wherein said first shielding device comprises first and second surfaces with conductive material on said first surface, and wherein said shielding device is positioned with said first surface facing said first winding.

36. An electronic device in accordance with claim 35 wherein said conductive material is in electrical contact with said first core portion.

37. An electrical device in accordance with claim 35 and further comprising, a second shielding device having first and second surfaces with conductive material disposed on said second surface, and wherein said shielding device is positioned with said second shielding device second surface facing said second core portion.

38. A shielding device for an electrical transformer having a first core portion and a second core portion, first and second windings on said first and second core portions respectively, said shielding device being constructed and arranged to electrically shield said first core portion from said second core portion, the shielding device having an electrically conductive portion on a surface thereof, the electrically conductive portion being electrically connected to a drain wire for conducting capacitive displacement currents back to their source.

39. A shielding device in accordance with claim 38 and further comprising, an electrically insulating substrate, and wherein the electrically conductive portion includes a pattern of electrically conductive material disposed on said substrate.

40. A shielding device in accordance with claim 39 wherein said pattern comprises, a plurality of parallel traces of said electrically conductive material, a connecting trace of said conductive material interconnecting said plurality of parallel traces, and the drain wire being electrically connected to said connecting trace.

41. A shielding device in accordance with claim 39, wherein said shielding device is disposed with said electrically conductive pattern facing said first winding.

42. A shielding device in accordance with claim 38 wherein said shielding device comprises, a sheet of material with a resistivity in the range of between 10 and 100 ohms per square.

43. A shielding device in accordance with claim 42 wherein said material comprises a carbon impregnated polymer.

44. hielding device in accordance with claim 38 wherein said shielding device comprises, an electrically insulating substrate, a conductive coating on said substrate having a surface resistivity in a range of between 10 and 100 ohms per square disposed on said electrically insulating substrate.

45. A shielding device in accordance with claim 44 wherein said conductive coating comprises indium tin oxide.

46. A shielding device in accordance with claim 38 wherein said first shielding device comprises first and second surfaces with conductive material disposed on said first surface, and wherein said shielding device is positioned so that said first surface faces said first winding.

47. A shielding device in accordance with claim 46 wherein said conductive material is in electrical contact with said first core portion.

48. A shielding device in accordance with claim 46 and further comprising a second shielding device having first and second surfaces with conductive material disposed on said second surface, and wherein said second shielding device is positioned so that said second shielding device second surface faces said second core portion.

49. Electrical apparatus comprising, a source of electrical energy, switching circuitry coupled to said source of electrical energy, a transformer coupled to said switching circuitry, said transformer having a core with first and second core portions, and a shielding device between said first and second core portions constructed and arranged to electrically shield said first core portion from said second core portion, the shielding device having an electrically conductive portion on a surface thereof, the electrically conductive portion being electrically connected to a drain wire for conducting capacitive displacement currents back to their source.

50. Electrical apparatus in accordance with claim 49 wherein said first and second core portions carry first and second windings respectively, and said shielding device is constructed and affanged to shield said first winding from said second winding.

51. Electrical apparatus in accordance with claim 50 wherein said shielding device comprises, an electrically insulating substrate, and wherein the electrically conductive portion includes a pattern of electrically conductive material disposed on said substrate.

52. Electrical apparatus in accordance with claim 51 wherein said pattern compnses, a plurality of parallel traces of said electrically conductive material, a connecting trace of said conductive material interconnecting said parallel traces, and the drain wire being electrically connected to said conducting trace.

53. Electrical apparatus in accordance with claim 49 wherein said shielding device comprises, a sheet of material with a surface resistivity of between 10 to 100 ohms per square.

54. Electrical apparatus in accordance with claim 53 wherein said material comprises a carbon impregnated polymer.

* * * * *